US007261153B2

(12) United States Patent
Plomp

(10) Patent No.: US 7,261,153 B2
(45) Date of Patent: Aug. 28, 2007

(54) PACKER CUPS

(76) Inventor: Albert E. Plomp, 96 Hampton Rise N.W., Calgary, Alberta (CA)

( * ) Notice: Subject to any disclaimer, the term of this patent is extended or adjusted under 35 U.S.C. 154(b) by 227 days.

(21) Appl. No.: 10/736,499

(22) Filed: Dec. 17, 2003

(65) Prior Publication Data

US 2005/0133218 A1 Jun. 23, 2005

(51) Int. Cl.
*E21B 33/126* (2006.01)

(52) U.S. Cl. ..... 166/202; 166/177.3; 277/335

(58) Field of Classification Search ..... 166/202, 166/177.4, 179, 177.3; 277/335, 626, 336, 277/627

See application file for complete search history.

(56) References Cited

U.S. PATENT DOCUMENTS

| | | | | |
|---|---|---|---|---|
| 2,069,212 | A * | 2/1937 | Buffington | 277/439 |
| 2,388,520 | A * | 11/1945 | Bowie | 277/439 |
| 3,450,412 | A | 6/1969 | Collett | |
| 4,129,308 | A | 12/1978 | Hutchison | |
| 4,149,566 | A | 4/1979 | Stowe | |
| 4,317,408 | A * | 3/1982 | Williams | 92/241 |
| 4,596,395 | A * | 6/1986 | Miser | 277/562 |
| 4,751,870 | A | 6/1988 | Gramling | |
| 5,028,056 | A | 7/1991 | Bemis et al. | |
| 5,499,826 | A * | 3/1996 | Pippert et al. | 277/437 |
| 6,390,196 | B1 * | 5/2002 | Montaron et al. | 166/290 |
| 6,554,068 | B1 * | 4/2003 | Chatterji et al. | 166/285 |
| 6,668,938 | B2 * | 12/2003 | Sheffield et al. | 166/387 |
| 2003/0024386 | A1 * | 2/2003 | Burke | 92/240 |
| 2003/0098153 | A1 | 5/2003 | Serafin | |

* cited by examiner

*Primary Examiner*—Kenneth Thompson

(57) ABSTRACT

A packer cup for use in sealing the interior of a pipe under pressure is described. The cup uses a bell-shaped end which has a lip of softer material which is integral with the body of the cup which is harder material. Under pressure the lip expands against the side of the pipe and as pressure increases the body of the bell also expands against the pipe.

5 Claims, 1 Drawing Sheet

PACKER CUPS

FIELD OF THE INVENTION

This invention relates to devices used to seal the interior of tubing or pipe so that pressure can be applied in the sealed off section. The device can be used to seal off formations when servicing wells or to pressure test tubing or pipe.

BRIEF DESCRIPTION OF THE PRIOR ART

It is known in the art to provide a bell-shaped resilient member to use as a seal to seal off a section of pipe so that the section can be tested with pressure. Such seals are normally reinforced elastomer and dimensioned so that when pressure is applied to the sealed off portion, the pressure causes the bell-shaped member to expand against the inner wall of the pipe and seal it. A mandrel is often used with such seal members.

Typically such packer cups are made of an elastomer. It is necessary with relatively soft materials to reinforce the cup and often the reinforcing is metal embedded in the elastomer prior to vulcanization. Such cups are shown in published patent application U.S. 2003/0098153 and U.S. Pat. No. 3,450,412. In the latter patent, fingers of metal are provided which extend longitudinally in the sides of the cup. During use the outer covering will often wear away exposing the metal reinforcing. In that case, movement of the cup within a well tube can bend the reinforcing material so that it snags within the tube, plugging it. In that case, it can be extremely expensive to open the pipe or tube.

In U.S. Pat. No. 4,149,566 a test cup is provided which has a bell-shaped end, L shaped metal-reinforcing ring segments embedded therein and an opposite tubular portion with an internal metal sleeve embedded therein. That patent describes a prior art cup constructed of an elastomer of two different hardnesses. It is described that the juncture between the two elastomers is a fault line and typically such a device fails along this line sooner than with other types of seals.

In U.S. Pat. No. 4,751,870 there is described a seal for oil and gas well swabs. The seals are primarily of rubber with a centrally located reinforcing tube of metal or plastic. In this patent however internal reinforcing ribs are provided to resist the tendency to expand under pressure against the walls of the pipe.

In U.S. Pat. No. 5,028,056 a composite material is described which is used to form a reinforced base for a pump piston. Resilient material is filled with reinforcing fibers to increase the stiffness of the seal.

In U.S. Pat. No. 4,129,308 the seal is mounted on a mandrel by a frangible backup ring. This assembly is intended to be broken up and left in the well hole and therefore does not include metal supports.

In each instance, the prior art packer cups, especially those which are formed of rubber, can fail prematurely. There is still a need again for a packer cup assembly which can seal a pipe or tube under pressure and which can be moved or removed when the pressure is released, and which will not fail prematurely.

SUMMARY OF THE INVENTION

It has been discovered that a superior packer cup can be provided with two different hardnesses in a single cup assembly wherein a fault line will not be present. The assembly of this invention is bell-shaped and may have a metal ring supporting the end opposite the bell, and at the bell lip, a softer material is provided so that it will expand under pressure to form a seal. As the pressure increases, the bell itself will expand to further reinforce the seal. In the preferred embodiment the material of construction is polyurethane having two different densities and hardnesses. The product is molded in a molten state with the less dense material disposed in the mold above the more dense material. The liquids intermix at the interface, and therefore, no fault line is provided between the materials of different density after they cure. The softer material may be from ¼ inch to 2 inches in depth depending on the customer's need or specifications. The cup of this invention may be used with a mandrel so that the end opposite the bell is dimensioned to receive the mandrel or other pipe with the bell end being dimensioned to be slidably received within the outer pipe.

Accordingly it an object of this invention to provide a superior packer cup having a lip of softer material, and a body of harder material with an optional metal sleeve disposed within the assembly at the end opposite the softer material, but no metal reinforcing members.

It is another object of this invention to provide a packer cup having a bell-shaped end and an opposite tubular end wherein the bell-shaped end has an integral lip of material which is less dense than that forming the remaining body of the cup.

It is still another object of this invention to provide a packer cup having two different densities of materials wherein the cup is molded of molten material wherein no line of demarcation is present between the two different materials.

It is still another object of this invention to provide a polyurethane packer cup wherein the cup forms a bell-shaped end and a tubular opposite end with the lip of the bell-shaped end being formed of polyurethane which is less dense than the material forming the rest of the packer cup and, wherein the lip is integral with the packer cup body.

These and other objects will become readily apparent with reference to the drawings and following description wherein:

DETAILED DESCRIPTION OF THE INVENTION

Figure 2:
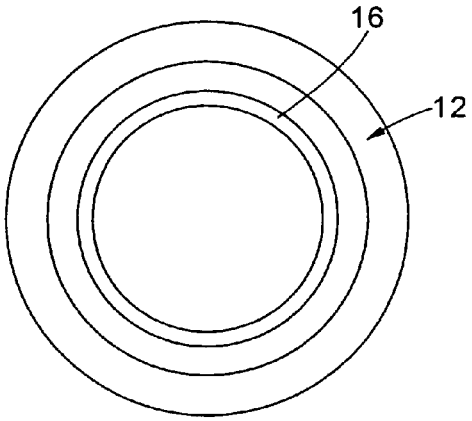
FIG. 2 is a top view of the cup of FIG. 1.

With attention to the drawings, the cup 10 of this invention has a bell-shaped end 12 and a tubular end 14. Disposed within the tubular end 14 is an optional steel sleeve 16. Sleeve 16 is typically secured within cup 10 with a conventional adhesive. In normal practice the sleeve would be sandblasted, and the adhesive used to secure the surface of the sleeve within the tubular end 14 of cup 10. The cup 10 also can be provided without sleeve 16, being constructed only of elastomer.

Figure 3:
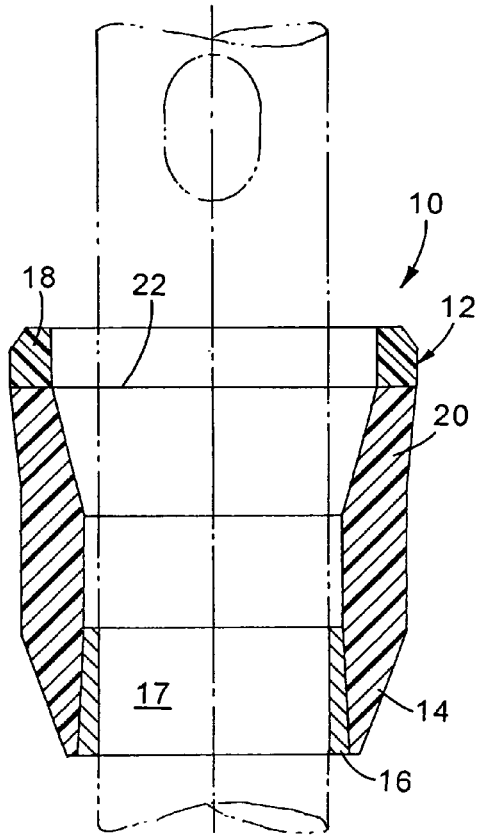
FIG. 3 is a cross sectional view of the packer cup of FIG. 1.
Figure 1:
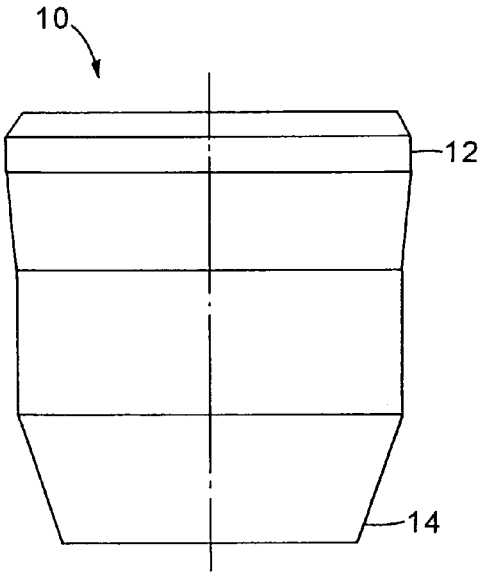
FIG. 1 is a side view of the packer cup of this invention.
Figure 4:
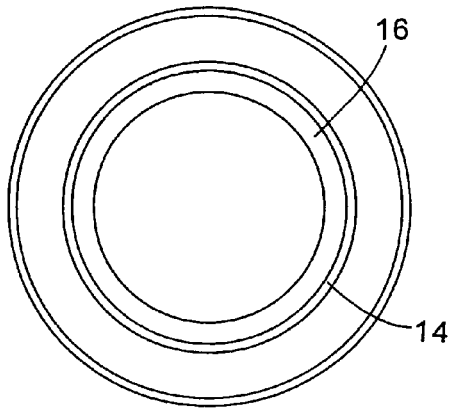
FIG. 4 is a bottom view of the cup of FIG. 1.

During use, the softer end or lip 18 of cup 10 will be expanded against the internal sides of a pipe with pressure admitted via a tube 17 passing through the tubular end 14 (See FIG. 3). This pressure will cause the lip 18 to seal against the internal surface of a pipe. As pressure is further increased, the body 20 of cup 10 will further expand against the sides of the pipe to provide a better seal at the higher pressure.

In a preferred embodiment the cup 10 is the elastomer polyurethane with the lip 12 at a density of about 1.07, and the cup itself at the higher density of about 1.3. Any of the well known elastomers could be used. The hardness of the cup could be 60 SHORE D with the lip being 80-95 SHORE A. In order to fabricate the cup, a mold (not shown) is used, and the polyurethane is poured in a molten state into the mold. The interface between the lip 12 and the body 20 is shown in FIG. 3 as a line 22. In reality however, the molten materials admix at their interface so that when the material cures, the lip 12 will be integral with the body 20.

Conventional packer cups made from an elastomer require reinforcing materials such as metal fingers to be embedded in the body of the cup. As the cup slides in the pipe, the elastomeric material will wear away and expose the metal fingers. These fingers can bend, and snag within the pipe.

The cup of this invention especially with polyurethane densities or hardnesses described above requires no reinforcing metal or other material to be present.

The lip 12 can be from a ¼ inch up to about 2 inches deep depending upon the customer's preference. The cup 10 can be over 3 inches high with the sleeve 16 being at least 1 inch high. This invention however is not intended to be limited to these dimensions and they are merely illustrative of an embodiment of a cup of this invention.

In summary then, a durable packer cup is described to seal an annulus within a pipe under pressure wherein the cup distorts to engage the internal surface of the pipe. In this way then, the pipe can be pressure tested or used to seal off formations when servicing wells. The cup of this invention does not have reinforcing metal parts and has a softer lip at the bell-shaped end which is integral with the body of the cup itself.

It will be readily seen by one of ordinary skill in the art that the present invention fulfills all of the objects set forth above. After reading the foregoing specification, one of ordinary skill will be able to effect various changes, substitutions or equivalents and various other aspects of the invention as broadly disclosed herein. It is therefore intended that the protection granted hereon be limited only by the definition contained in the appended claims and equivalents thereof.

What is claimed:

1. A packer cup for use sealing an annulus between a pipe and a coaxially mounted tube, said cup adapted to surround said tube comprising:

an elongated, hollow sleeve having first and second end openings disposed, coaxially, along the longitudinal axis of said sleeve, said sleeve having a bell-shaped portion surrounding the first end and a tubular portion surrounding the second opening; said bell-shaped portion having an outer diameter adapted to be slightly less than the inner diameter of said pipe; a lip surrounding said first opening integral with said sleeve, said cup being constructed of an elastomeric material which is expandable responsive to internal pressure within said sleeve with said sleeve of a harder material than said lip wherein said sleeve and lip are constructed from polyurethane.

2. The cup of claim 1 wherein the hardness of the sleeve is about 60 SHORE D.

3. The cup of claim 2 wherein the lip has a hardness of 80-95 SHORE A.

4. A packer cup for use sealing an annulus between a pipe and a coaxially mounted tube, said cup adapted to surround said tube comprising:

an elongated, hollow sleeve having first and second end openings disposed, coaxially, the longitudinal axis of said sleeve, said sleeve having a bell-shaped portion surrounding the first end and a tubular portion surrounding the second opening; said bell-shaped portion having an outer diameter adapted to be slightly less than the inner diameter of said pipe; a lip surrounding said first opening integral with said sleeve, said cup being constructed of an elastomeric material e with said sleeve of a harder material than said lip further comprising a metal sleeve disposed in said elastomer sleeve disposed within the second opening.

5. The cup of claim 4 wherein said metal sleeve is secured within said cup by adhesive.

* * * * *